US011944199B2

(12) United States Patent
Li et al.

(10) Patent No.: US 11,944,199 B2
(45) **Date of Patent: *Apr. 2, 2024**

(54) MECHANICAL STRETCHING DEVICE FOR MOVABLE SEAT UNIT AND SEAT UNIT

(71) Applicant: REMACRO TECHNOLOGY CO., LTD., Jiangsu (CN)

(72) Inventors: Xiaohong Li, Jiangsu (CN); Yuankun Li, Jiangsu (CN); Zhanzheng Lv, Jiangsu (CN); Haibo Wang, Jiangsu (CN)

(73) Assignee: REMACRO TECHNOLOGY CO., LTD., Jiangsu (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/235,803

(22) Filed: Aug. 18, 2023

(65) Prior Publication Data

US 2023/0389705 A1 Dec. 7, 2023

Related U.S. Application Data

(63) Continuation of application No. 18/111,815, filed on Feb. 20, 2023, now abandoned, which is a (Continued)

(30) Foreign Application Priority Data

Oct. 27, 2021 (CN) ..... 202111258022.4

(51) Int. Cl.
*A47C 1/034* (2006.01)
*A47C 1/032* (2006.01)
(Continued)

(52) U.S. Cl.
CPC ..... *A47C 1/0345* (2013.01); *A47C 1/03211* (2013.01); *A47C 1/035* (2013.01); *A47C 1/0355* (2013.01); *A47C 7/5068* (2018.08)

(58) Field of Classification Search
CPC ... A47C 1/0345; A47C 1/03211; A47C 1/035; A47C 1/0355; A47C 7/5068
See application file for complete search history.

(56) References Cited

U.S. PATENT DOCUMENTS 3,394,965 A 7/1968 Fletcher
4,108,491 A 8/1978 Rogers, Jr.
(Continued)

FOREIGN PATENT DOCUMENTS

CN 110051153 A 7/2019
CN 113892772 A 1/2022
(Continued)

*Primary Examiner* — Robert Canfield
(74) *Attorney, Agent, or Firm* — Arch & Lake LLP

(57) ABSTRACT

The present disclosure relates to a mechanical stretching device for a movable seat unit, and a movable seat unit thereof. The mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state.

20 Claims, 5 Drawing Sheets

Related U.S. Application Data continuation of application No. 17/881,561, filed on Aug. 4, 2022, which is a continuation of application No. 17/520,274, filed on Nov. 5, 2021, now Pat. No. 11,452,378.

(51) Int. Cl.

| | |
|---|---|
| ***A47C 1/035*** | (2006.01) |
| ***A47C 1/0355*** | (2013.01) |
| ***A47C 7/50*** | (2006.01) |

(56) References Cited

U.S. PATENT DOCUMENTS

| | | | | |
|---|---|---|---|---|
| 5,121,967 | A | 6/1992 | Rogers | |
| 8,915,544 | B2 * | 12/2014 | LaPointe | A61G 5/14 297/DIG. 10 |
| 10,426,266 | B2 * | 10/2019 | Wu | A47C 17/04 |
| 10,842,274 | B1 | 11/2020 | Crawford et al. | |
| 11,406,191 | B2 * | 8/2022 | Chen | A47C 31/023 |
| 11,452,378 | B1 * | 9/2022 | Li | A47C 7/5068 |
| 11,617,446 | B2 * | 4/2023 | Zhang | A47C 7/5068 297/423.26 |
| 11,700,942 | B2 * | 7/2023 | Li | A47C 17/04 297/85 R |
| 11,744,368 | B2 * | 9/2023 | Li | A47C 1/0352 297/84 |
| 2003/0015893 | A1 | 1/2003 | Hoffman et al. | |
| 2010/0127555 | A1 | 5/2010 | Hoffman et al. | |
| 2012/0049606 | A1 | 3/2012 | Lawson et al. | |
| 2012/0299363 | A1 | 11/2012 | Crum | |
| 2015/0054315 | A1 | 2/2015 | Donovan et al. | |
| 2015/0272335 | A1 | 10/2015 | Lawson et al. | |
| 2015/0289655 | A1 | 10/2015 | Lawson | |
| 2018/0027965 | A1 | 2/2018 | Lawson | |
| 2018/0027968 | A1 | 2/2018 | Lawson et al. | |
| 2018/0094711 | A1 | 4/2018 | Lawson et al. | |
| 2019/0216221 | A1 | 7/2019 | Bryant | |
| 2019/0290004 | A1 * | 9/2019 | Lawson | A47C 1/0355 |
| 2020/0367652 | A1 | 11/2020 | Crawford et al. | |
| 2021/0112983 | A1 | 4/2021 | Bryant | |
| 2021/0219725 | A1 | 7/2021 | Sun | |
| 2021/0219727 | A1 | 7/2021 | Zhang et al. | |
| 2021/0353064 | A1 | 11/2021 | Chen et al. | |
| 2021/0361070 | A1 | 11/2021 | Zhang et al. | |
| 2022/0039558 | A1 | 2/2022 | Zhang | |

FOREIGN PATENT DOCUMENTS

| | | | |
|---|---|---|---|
| CN | 113907551 | A | 1/2022 |
| DE | 202011004992 | U1 | 6/2011 |
| WO | 2015096305 | A1 | 7/2015 |

* cited by examiner

MECHANICAL STRETCHING DEVICE FOR MOVABLE SEAT UNIT AND SEAT UNIT

CROSS-REFERENCE TO RELATED APPLICATION

The present application is based on and claims the priority to the U.S. patent application Ser. No. 18/111,815 filed on Feb. 20, 2023, which claims priority to U.S. patent application Ser. No. 17/881,561 filed on Aug. 4, 2022, which claims priority to U.S. patent application Ser. No. 17/520,274 filed Nov. 5, 2021 issued as U.S. Pat. No. 11,452,378 on Sep. 27, 200, which claims the priority to the Chinese Patent Application No. 202111258022.4, filed on Oct. 27, 2021, the entire content of which is hereby incorporated by reference for all purposes.

TECHNICAL FIELD

The present disclosure relates to a mechanical stretching device for a movable seat unit and a seat unit including the same.

BACKGROUND

The movable seat unit is applied to a variety of scenarios, such as sofas or seats having a multi-position convertible function. With the improvement of people's living standards, increasingly higher requirements are imposed on the comfort of the sofas and seats. The movable seat unit is typically provided with a mechanical stretching device, through which the seat unit can be converted between a sitting state, a relaxing state (or a TV position), and a lying state. When the seat unit is converted from the sitting state to the relaxing state, the footrest of the seat unit is stretched forward and the angle between the backrest and the seating portion keeps substantially unchanged; and when the seat unit is converted from the relaxing state to the lying state, the footrest is further forward and upward than in the relaxing state, and the backrest bends backward obviously, such that the user on the seat unit in the lying state has the legs higher than the head and experiences the so-called "zero gravity." However, the seating portion of some seat units is raised upward obviously to affect the comfort of the user.

SUMMARY

The present disclosure provides a mechanical stretching device for a movable seat unit, and a movable seat unit thereof.

The first aspect of the present disclosure provides a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism; and in the lying state, an angle between an extension direction of the footrest element and the horizontal direction is in a range between 9° and 23°.

In the second aspect of the present disclosure, a movable seat unit is provided. The movable seat unit includes: a seating portion, a backrest, a footrest, a motor driving device, and a mechanical stretching device as described above in the first aspect of the present disclosure.

The third aspect of the present disclosure provides a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism. In the lying state, a height difference between the highest point of the leg stretching structure and the highest point of the back mechanism is in a range between 200 mm and 400 mm.

The third aspect of the present disclosure provides a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism. In the lying state, a height difference between the highest point of the leg stretching structure and the highest point of the back mechanism is in a range between 200 mm and 400 mm; and in the lying state, an angle between an extension direction of the footrest element and the horizontal direction is in a range between 9° and 23°.

It is to be understood that both the foregoing general description and the following detailed description are exemplary and explanatory only and are not restrictive of the present disclosure.

BRIEF DESCRIPTION OF THE DRAWINGS

Implementations of the present disclosure will be described below in detail with reference to the accompanying drawings.

DETAILED DESCRIPTION

The present disclosure is described with reference to examples and corresponding drawings. The described examples are only part but not all of the examples of the present disclosure. Based on the examples in the present disclosure, all other examples obtained by those ordinary skilled in the art without any inventive work belong to the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Figure 1:
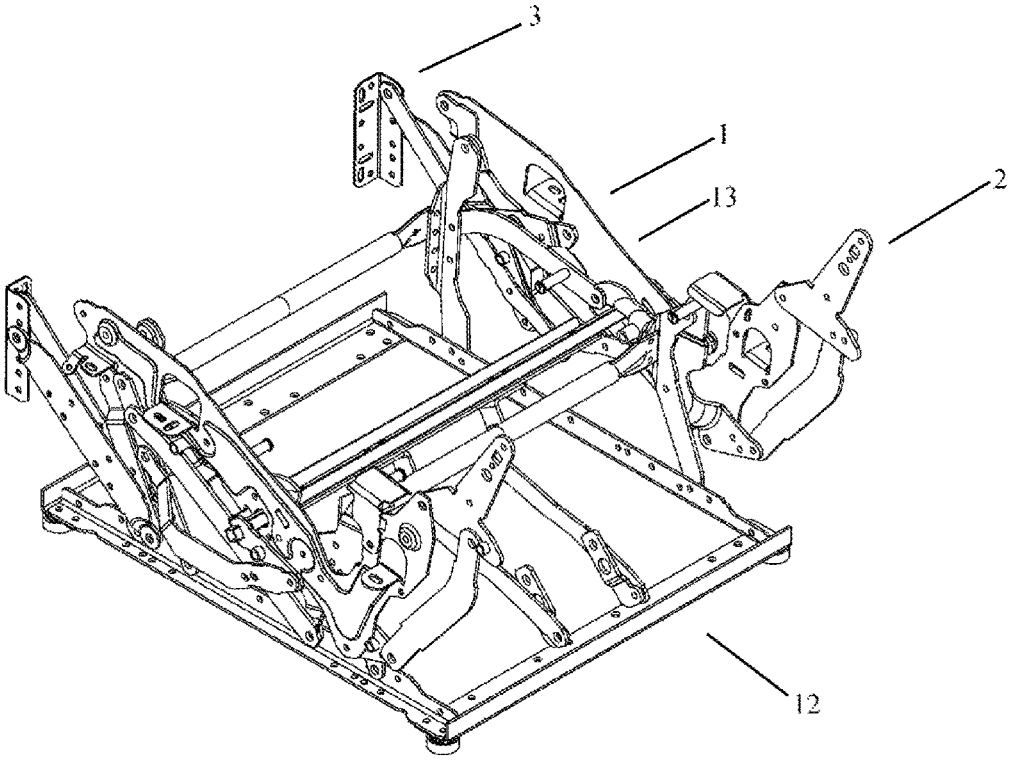
FIG. 1 is a stereoscopic view of a mechanical stretching device in a sitting state according to one or more examples of the present disclosure.
Figure 2:
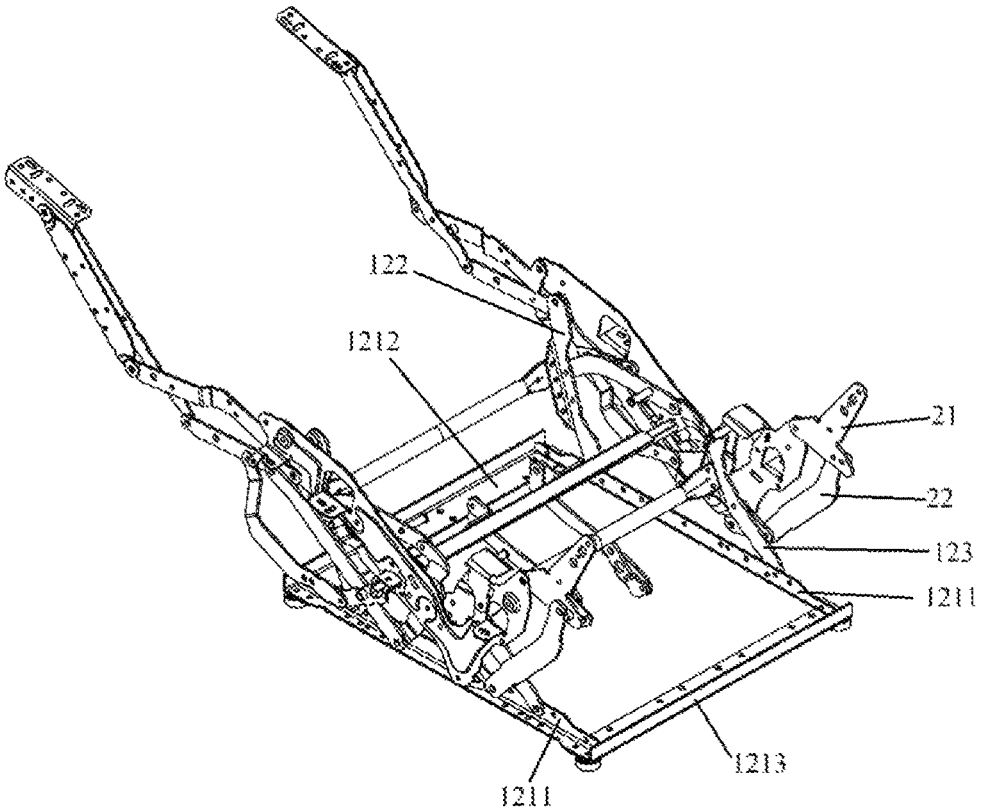
FIG. 2 is a stereoscopic view of a mechanical stretching device in a relaxing state according to one or more examples of the present disclosure.
Figure 3:
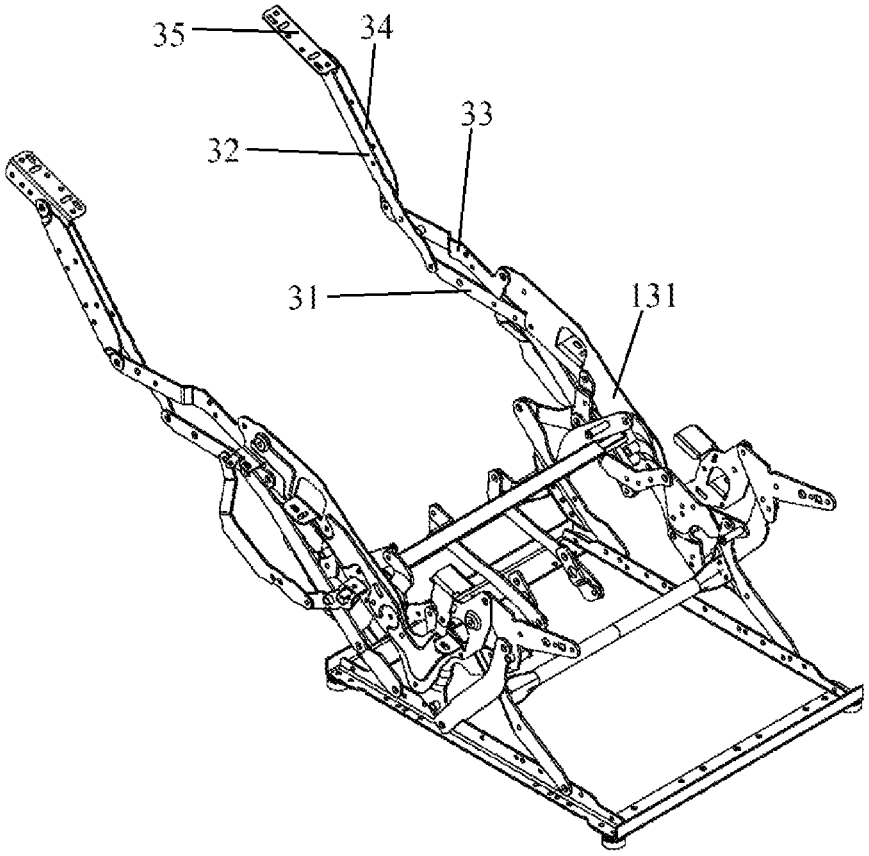
FIG. 3 is a stereoscopic view of a mechanical stretching device in a lying state according to one or more examples of the present disclosure.
Figure 4:
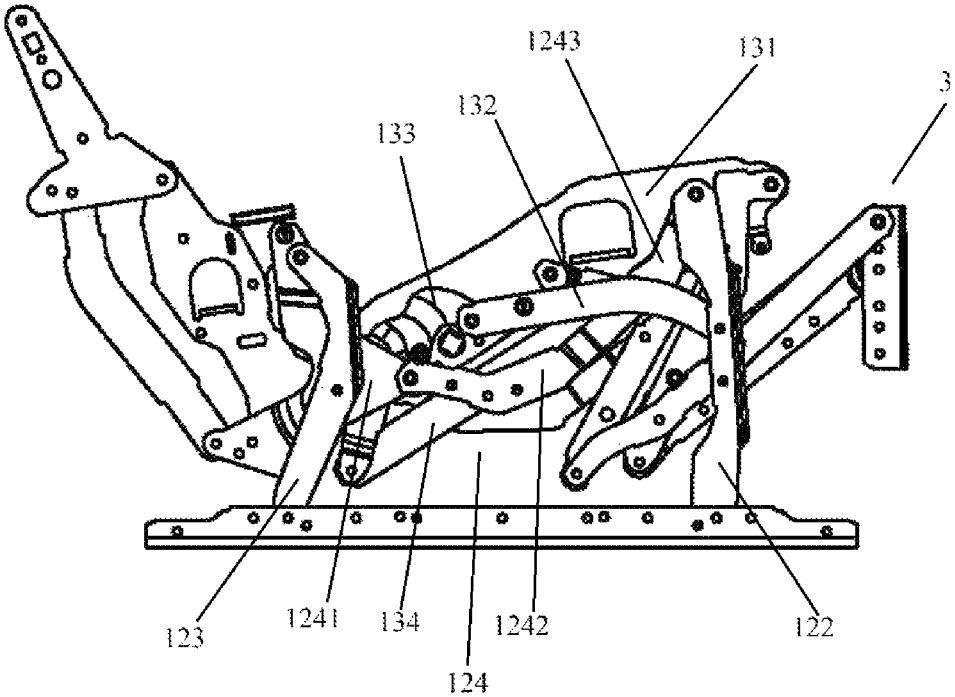
FIG. 4 is a side view of a mechanical stretching device in a sitting state according to one or more examples of the present disclosure.

The description of numerals used in this disclosure may include:

1 linkage support
12 Support structure
121 Base
1211 Lateral rail
1212 Front transverse rail
1213 Rear transverse rail
122 First support element
123 Second support element
124 Base coupling component
1241 Back coupling element
1242 Seat coupling element
1243 Lateral plate coupling
13 linkage structure
131 Lateral plate
132 First coupling element
133 Second coupling element
134 Third coupling element
14 Transmission structure
141 First transmissive element
142 Second transmissive element
2 Back mechanism
21 Backrest connection element
22 Back connecting rod
3 Leg stretching device
31 First connecting rod
32 Second connecting rod
321 First connecting point
322 Second connecting point
33 Third connecting rod
34 Fourth connecting rod
341 Footrest connecting point
342 Coupling rod connecting point
342 Connection element connecting point
35 First footrest element
351 Second connecting rod connecting point
352 linkage point
36 Coupling rod
37 Second footrest element
371 First limit element
38 Footrest connection element
381 First connection element
382 Second connection element
383 Vertical section
39 Footrest plate component
391 First footrest plate
392 Second footrest plate FIG. 1 to FIG. 3 schematically illustrate an example of a mechanical stretching device for a movable seat unit. The mechanical stretching device includes: a linkage support 1, a back mechanism 2, and a leg stretching structure 3.

Specifically, the linkage support 1 includes a support structure 12 and a linkage structure 13.

The support structure 12 includes a base 121, a first support element 122, a second support element 123, and a base coupling component 124. The base 121 includes two lateral rails 1211 in a mirror symmetry on a left side and a right side, and optionally further includes a front transverse rail 1212 and a rear transverse rail 1213 for connecting the two lateral rails 1211. A lower end of the first support element 122 is hinged to a front end of the lateral rail 1211, a lower end of the second support element 123 is hinged to a rear end of the lateral rail 1211, and the base coupling component 124 is provided between the first support element 122 and the second support element 123.

The linkage structure 13 includes a lateral plate 131, a first coupling element 132, a second coupling element 133, and a third coupling element 134, a middle of the second coupling element 133 is rotatably connected to the lateral plate 131, one end of the second coupling element 133 is connected to one end of the first coupling element 132, the other end of the first coupling element 132 is connected to the first support element 122, the other end of the second coupling element 133 is connected to one end of the third coupling element 134, and the other end of the third coupling element 134 is pivotally connected to the leg stretching structure 3.

Specifically, the back mechanism 2 includes a backrest connection element 21 attached to a backrest and a back connecting rod 22 pivotally connected to the backrest connection element. The backrest connection element 21 is hinged to a rear end of the lateral plate 131 of the linkage structure 3.

Specifically, the leg stretching structure 3 is composed of multiple connecting rods that are pivotally connected to one another, where a rear end of a first connecting rod 31 is hinged to the lateral plate 131 of the linkage structure 13, a front end of the first connecting rod 31 is hinged to a rear end of a second connecting rod 32, a rear end of a third connecting rod 33 is hinged to a front end of the lateral plate 131, a front end of the third connecting rod 33 is hinged to a rear end of a fourth connecting rod 34, a front end of each of the second connecting rod 32 and the fourth connecting rod 34 is hinged to a first footrest element 35, an end of the second connecting rod 32 close to the first connecting rod 31 is provided with a first connecting point 321, and the second connecting rod 32 is hinged to a middle of the third connecting rod 33 at the first connecting point 321.

Specifically, the base coupling component 124 includes: a back coupling element 1241, a seat coupling element 1242, and a lateral plate coupling element 1243, where the back coupling element 1241 is provided with multiple pivotal points; and the back coupling element is respectively hinged to the back connecting rod 22 of the back mechanism 2, the lateral plate 131 of the linkage structure 13, the seat coupling element 1242 and the second support element 123 by means of different pivotal points. One end of the seat coupling element 1242 is connected to the first support element 122 by means of the lateral plate coupling element 1243, and the other end of the seat coupling element 1242 is connected to the back coupling element 1241.

Specifically, the linkage support 1 further includes a transmission structure 14, the transmission structure 14 includes a first transmissive element 141 and a second transmissive element 142 that are connected to one another, the first transmissive element is connected to a driving device, the second transmissive element is connected to the first connecting rod 31 of the leg stretching structure 3, and the driving device drives a movement of the linkage support by means of the transmission structure. In some examples, the driving device may be a manual driving device; and in other examples, the driving device may be a motor driving device, and the motor driving device may be a push rod motor or slider motor driving device.

According to the example, the movement of the linkage support 1 drives the back mechanism 2 and the leg stretching device 3 for stretching or retracting, such that the mechanical stretching device can implement a sequential conversion or a reverse sequential conversion of the seat unit from a sitting state shown in FIG. 1 to a relaxing state shown in FIG. 2 and then to a lying state shown in FIG. 3. In the sitting state, the first footrest element 35 is folded below a seating portion; in the relaxing state, the first footrest element 35 is stretched to be in front of the seating portion; and in the lying state, an angle between the backrest and the seating portion is increased relative to the relaxing state, and the first footrest element 35 extends further forward and upward than in the relaxing state, as shown in FIG. 6, such that a height of a highest point of the leg stretching structure 3 relative to a horizontal plane is greater than that of a highest point of the back mechanism 2 relative to the horizontal plane, with a height difference being in a range between 200 mm and 400 mm, and is preferably 265 mm.

An included angle $\alpha$ is formed between an end surface of the footrest element and the horizontal direction, and an included angle $\beta$ is formed between the seating portion or a contact surface on which the lateral plate 131 is coupled to the seating portion and the horizontal direction.

Figure 5:
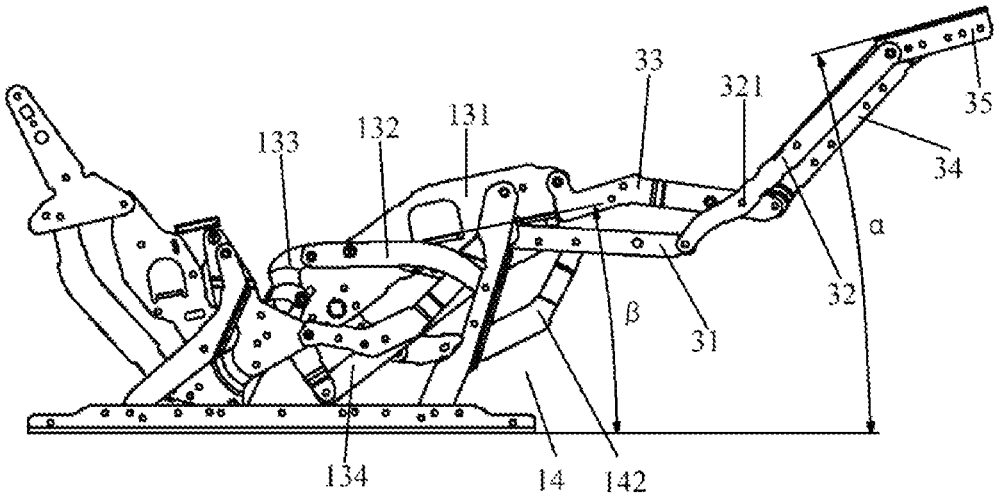
FIG. 5 is a side view of a mechanical stretching device in a relaxing state according to one or more examples of the present disclosure.
Figure 6:
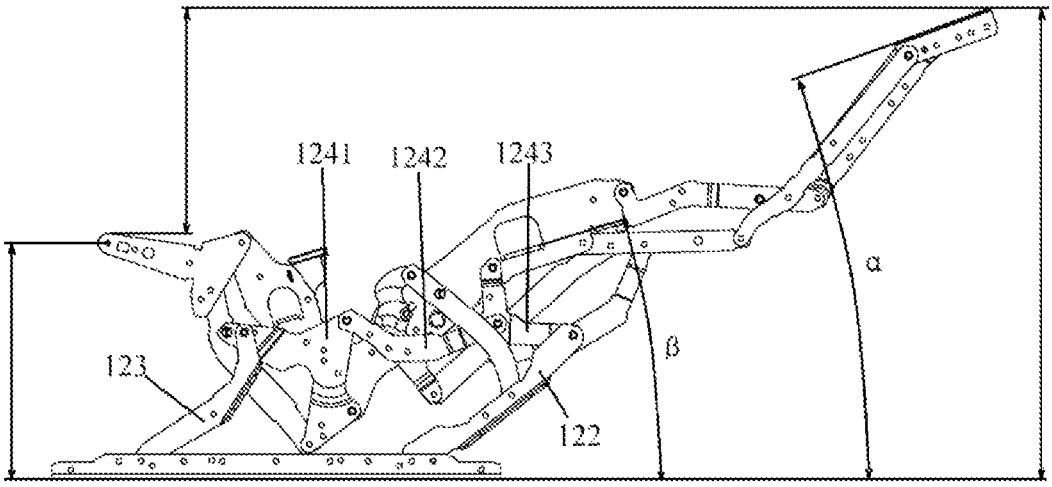
FIG. 6 is a side view of a mechanical stretching device in a lying state according to one or more examples of the present disclosure.

As shown in FIG. 5 to FIG. 6, the included angle $\alpha$ between the footrest element in the relaxing state and the horizontal direction is less than the included angle $\alpha$ between the footrest element in the lying state and the horizontal direction. Specifically, in the relaxing state, the angle $\alpha$ formed between the footrest element and the horizontal direction is in a range between 8° and 20°, preferably between 12° and 19°, and more preferably between 14° and 15°; and in the lying state, the angle $\alpha$ formed between the footrest element and the horizontal direction is in a range between 9° and 23°, preferably 14° and 21°, and more preferably 18° and 19°.

In the lying state, the angle $\beta$ formed between the seating portion and the horizontal direction is in a range between 8° and 17°, and preferably between 13° and 16°.

FIG. 7 to FIG. 11 illustrate a second alternative example of the present disclosure.

Figure 7:
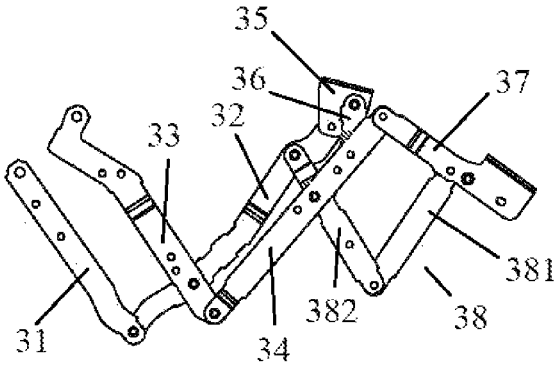
FIG. 7 is a schematic structural view of a footrest extension mechanism according to one or more examples of the present disclosure.

An example further provides a mechanical stretching device for a movable seat unit. The difference between the second example and the first example mainly lies in the design of the leg stretching structure. According to the second example, the leg stretching mechanism 3 is constructed as a footrest extension mechanism as shown in FIG. 7, including: a first connecting rod 31, a second connecting rod 32, a third connecting rod 33, a fourth connecting rod 34, a first footrest element 35, a coupling rod 36, a second footrest element 37 and a footrest connection element 38.

One end of the second connecting rod 32 is hinged to the first footrest element 35, the other end of the second connecting rod 32 is hinged to the first connecting rod 31, the first connecting rod 31 is hinged to the linkage support 1 of the seat unit, one end of the fourth connecting rod 34 is hinged to the second footrest element 37, the other end of the fourth connecting rod 34 is hinged to the third connecting rod 33, the first footrest element 35 is hinged to one end of the coupling rod 36, and the other end of the coupling rod 36 is hinged to a middle of the fourth connecting rod 34.

The footrest connection element 38 includes a first connection element 381 and a second connection element 382, one end of the first connection element 381 is hinged to a middle of the second footrest element 37, the other end of the first connection element 381 is hinged to one end of the second connection element 382, the other end of the second connection element 382 is hinged to a middle of the second connecting rod 32, and a middle of the second connection element 382 is hinged to the middle of the fourth connecting rod 34.

In the example, the first footrest element 35 is hinged to the fourth connecting rod 34 by means of the coupling rod 36, the fourth connecting rod is connected to the second footrest element, and the first footrest element 35 is not connected to the fourth connecting rod, such that the first footrest element and the second footrest element are retracted or stretched more flexibly. The first footrest element 35, the coupling rod 36, the fourth connecting rod 34, the second connection element 382, and the second connecting rod 32 are formed into a five-rod structure, which implements the effect that the first footrest element can be drawn close to or spaced apart from the second footrest element more flexibly, increases a distance between the first footrest element and the second footrest element that are spaced apart, and increases an extended length of the second footrest element.

Specifically, the middle of the second footrest element 37 is provided with a first limit element 371, and when the first limit element 371 abuts against the second connection element 382, the second footrest element 37 is retracted to a limit position. In the example, the first limit element 371 limits a maximum retracted position of the second footrest element, to avoid a phenomenon that the second footrest element is not retracted to a predetermined position and is loose. Meanwhile, a footrest surface of the second footrest element and a footrest surface of the first footrest element are in the same vertical plane, thereby improving the aesthetics of the seat in the retracted state.

Specifically, an end of the second connecting rod 32 close to the first connecting rod 31 is provided with a first connecting point 321, the second connecting rod 32 is hinged to a middle of the third connecting rod 33 at the first connecting point 321, and the third connecting rod 33 is connected to the linkage support 1. The second connecting rod 32 is intersected with the third connecting rod 33.

Specifically, an end of the second connecting rod 32 close to the first footrest element 35 is provided with a second connecting point 322, and the second connecting rod 32 is connected to the second connection element 382 at the second connecting point 322. In the example, the first connection element 381 and the second connection element 382 are used to connect and support the second footrest element 37, and the second footrest element 37, the first connection element 381, the second connection element 382, and the fourth connecting rod 34 are formed into a foldable and stretchable four-rod structure to support and drive the second footrest element 37 for stretching.

Specifically, an end of the fourth connecting rod 34 close to the second footrest element 37 is sequentially provided with a footrest connecting point 341, a coupling rod connecting point 342, and a connection element connecting point 343; and the fourth connecting rod 34 is connected to the second footrest element 37 at the footrest connecting point 341, the fourth connecting rod 34 is connected to the coupling rod 36 at the coupling rod connecting point 342, the fourth connecting rod 34 is connected to the second connection element 382 at the connection element connecting point 343, and the coupling rod connecting point 342 is provided between the footrest connecting point 341 and the connection element connecting point 343.

Specifically, a second connecting rod connecting point 351 and a linkage point 352 are arranged on the first footrest element 35, and a distance from the linkage point 352 to the coupling rod connecting point 342 is greater than that from the linkage point 352 to the second connecting rod connecting point 351. Specifically, the distance from the linkage point 352 to the second connecting rod connecting point 351 is less than that from the linkage point 352 to the coupling rod connecting point 342, such that the second connecting rod 32 drives the second connecting rod connecting point 351 to move downward relative to the linkage point 352 when the first footrest element 35 is stretched, the footrest surface of the first footrest element 35 smoothly rotates to a horizontal position where the footrest surface is upward, and thus the first footrest element is stretched more flexibly and quickly.

Specifically, in the example, the first connecting rod 31, the second connecting rod 32, the third connecting rod 33, the fourth connecting rod 34, the first footrest element 35, the coupling rod 36, the second footrest element 37 and the footrest connection element 38 are all pivotally connected or hinged; and all parts may be connected by means of a rotary shaft, a shaft pin, a rivet, a bolt, a nut and a combination thereof or other fasteners capable of implementing the pivotal connection.

Optionally, in the example, when the footrest extension mechanism is retracted to the limit position, the first footrest element 35 is located above the second footrest element 37, and the footrest surface of the first footrest element 35 and the footrest surface of the second footrest element 37 may be in the same vertical plane. When the footrest extension mechanism is stretched to a limit position from a retracted position, the footrest surface of each of the first footrest element 35 and the second footrest element 37 rotates upward, and the first footrest element 35 and the second footrest element 37 are spaced apart from one another.

Figure 8:
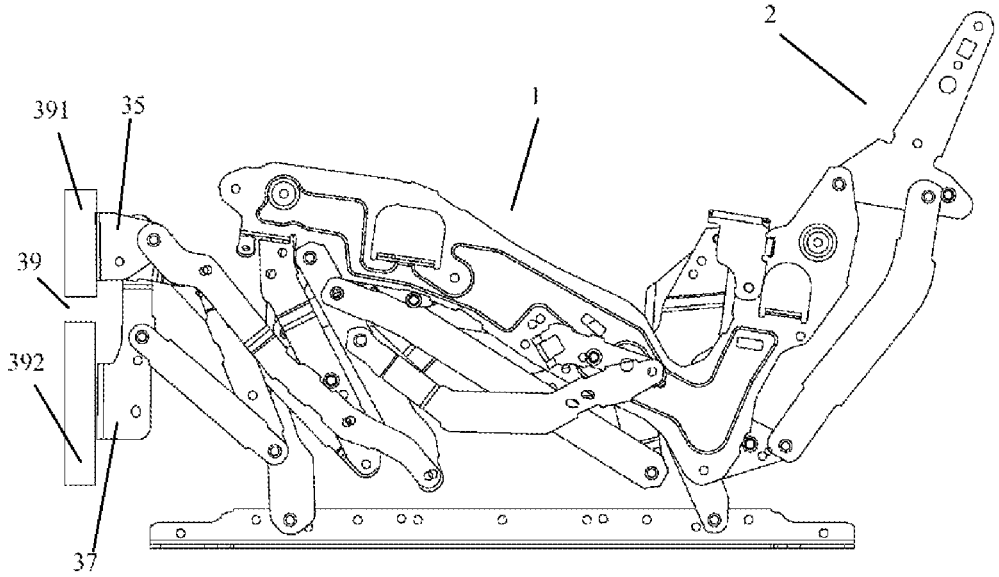
FIG. 8 is a schematic structural view of a seat stretchable device in a sitting state according to one or more examples of the present disclosure.

Specifically, as shown in FIG. 8, the footrest extension mechanism further includes a footrest plate component 39, where the footrest plate component 39 includes a first footrest plate 391 and a second footrest plate 392, the first footrest plate 391 is connected to the first footrest element 35, and the second footrest plate 392 is connected to the second footrest element 37. Specifically, a footrest surface bending inward is respectively provided on the first footrest element and the second footrest element, and the footrest surface is fixedly connected to the footrest plate, namely the first footrest plate and the second footrest plate are respectively fixed on the corresponding footrest surface.

Figure 9:
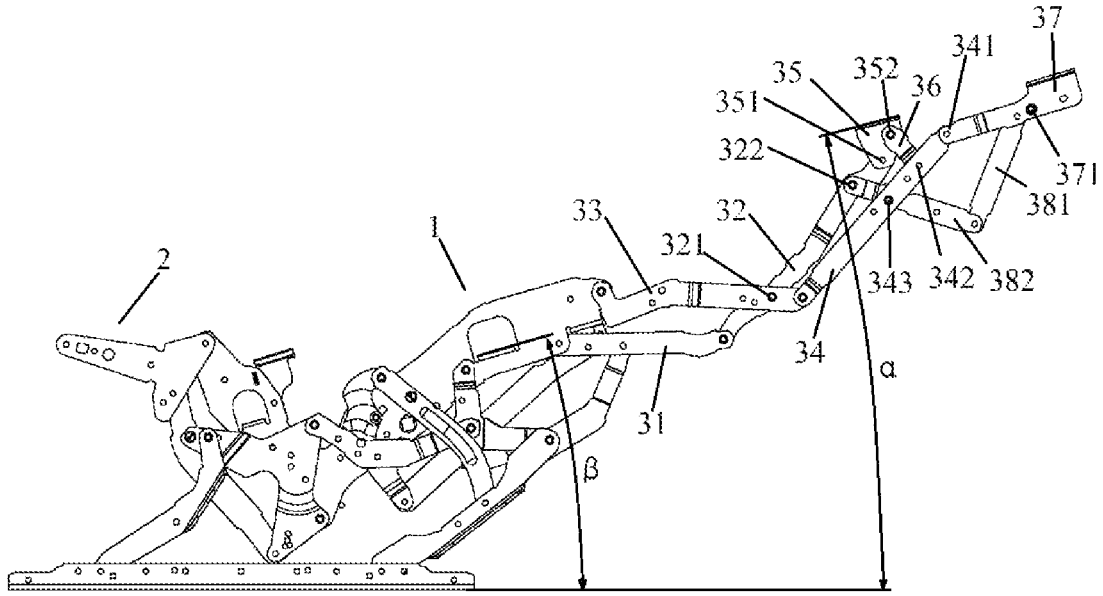
FIG. 9 is a schematic structural view of a seat stretchable device in a stretched lying state according to one or more examples of the present disclosure.
Figure 10:
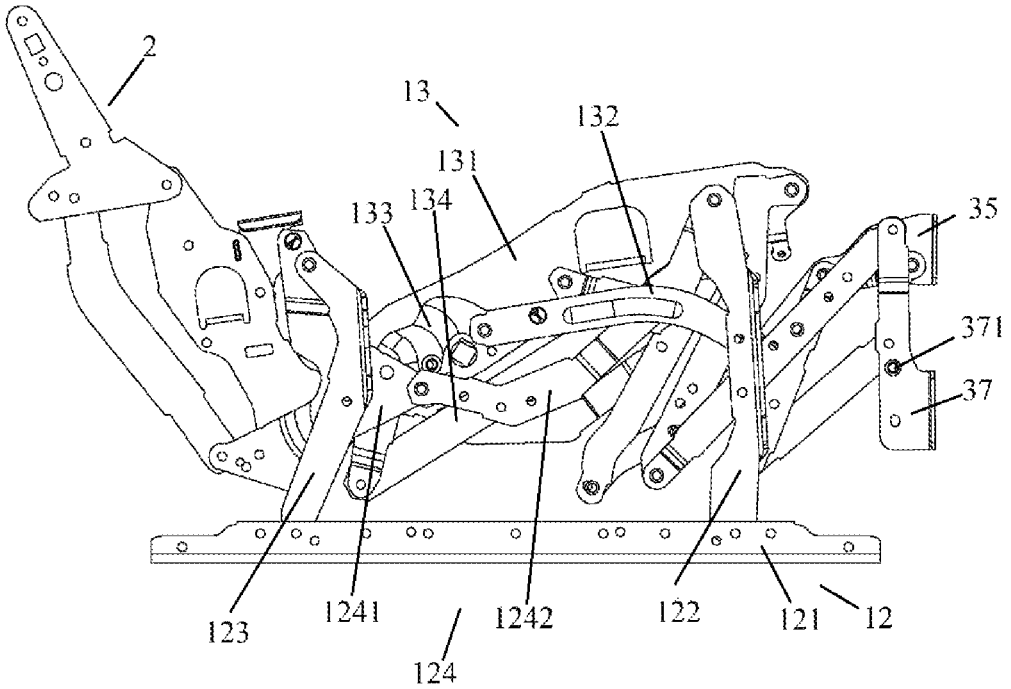
FIG. 10 is a schematic structural view of the other side of FIG. 8.
Figure 11:
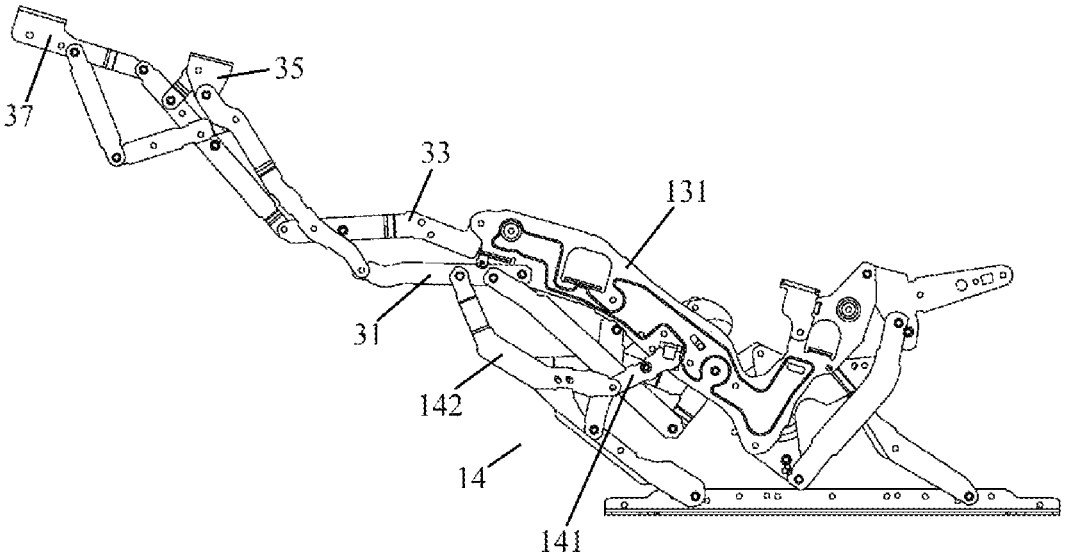
FIG. 11 is a schematic structural view of the other side of FIG. 9.

In the example, as shown in FIG. 8 and FIG. 9, the linkage support 1 of the seat drives the first connecting rod 31 and the third connecting rod 33 to rotate, such that the footrest extension mechanism moves from the retracted position shown in FIG. 8 to the stretched position shown in FIG. 9, and at the stretched position, the footrest surface of each of the first footrest element 35 and the second footrest element 37 is horizontal. When the footrest extension mechanism is stretched from the retracted position to the limit position, the second connecting rod 32 drives the first footrest element 35 to rotate upward and the coupling rod 36 rotates with the first footrest element 35, such that while the first footrest element 35 rotates more flexibly, the first footrest element 35 is supported; and the fourth connecting rod 34 drives the second footrest element 37 and the footrest connection element 38 to extend forward and rotate upward, until the second footrest element 37 is stretched to the limit position. When the footrest extension mechanism is retracted from the stretched position to the limit position, movement directions of components in the footrest extension mechanism are reversed to those in the stretching process.

In some examples, when the footrest extension mechanism is stretched to the limit position, a distance between the first footrest element and the second footrest element is greater than 140 mm, and may be preferably 145 mm, 147 mm, 150 mm, or 155 mm, namely the spacing distance after the first footrest element and the second footrest element are stretched is increased.

In the footrest extension mechanism of the present disclosure, the first footrest element is hinged to the fourth connecting rod by means of the coupling rod, such that the first footrest element and the second footrest element can be drawn close and separated apart more flexibly; when the footrest extension mechanism is retracted, the two footrest elements are retracted and drawn close, with a small space occupation; and when the footrest extension mechanism is stretched, the stretched length of the footrest extension mechanism is increased to better support legs and feet, improve the comfort of the seat and meet use requirements of users at different heights.

An example further provides a seat stretching device as shown in FIGS. 8-11, including: a leg stretching device 3 constructed as a footrest extension mechanism, a linkage support 1, and a back mechanism 2, where one end of the linkage support 1 is connected to the back mechanism 2, the other end of the linkage support 1 is connected to the footrest extension mechanism, and the footrest extension mechanism is connected to a footrest plate component 39.

Specifically, the linkage support 1 includes a support structure 12 and a linkage structure 13, the support structure 12 including a base 121, a first support element 122, a second support element 123, and a base coupling component 124, where one end of the base 121 is connected to the first support element 122, the other end of the base 121 is connected to the second support element 123, and the base coupling component 124 is provided between the first support element 122 and the second support element 123. Specifically, the base coupling component 124 includes: a seat coupling element 1242 and a back coupling element 1241, one end of the seat coupling element 1242 is connected to the first support element 122, and the other end of the seat coupling element 1242 is connected to the back coupling element 1241.

Specifically, the linkage structure 13 includes: a lateral plate 131, a first coupling element 132, a second coupling element 133 and a third coupling element 134, a middle of the second coupling element 133 is rotatably connected to the lateral plate 131, one end of the second coupling element 133 is connected to one end of the first coupling element 132, the other end of the first coupling element 132 is connected to the first support element 122, the other end of the second coupling element 133 is connected to one end of the third coupling element 134, and the other end of the third coupling element 134 is pivotally connected to the footrest extension mechanism.

Specifically, the linkage support 1 further includes a transmission structure 14, the transmission structure 14 includes a first transmissive element 141 and a second transmissive element 142 that are connected to one another, the first transmissive element is connected to a driving device, the second transmissive element is connected to the footrest extension mechanism, and the driving device drives a movement of the linkage support by means of the transmission structure. In some examples, the driving device may be a manual driving device; and in other examples, the driving device may be a motor driving device, and the motor driving device may be a push rod motor or slider motor driving device.

Specifically, in the example, the back mechanism 2 is connected to the lateral plate 131 of the linkage structure 13; and the movement of the linkage support 1 drives the back mechanism 2 and the footrest extension mechanism for stretching or retracting.

In the example, the footrest extension mechanism and the back mechanism can also be continuously adjusted; when only the footrest extension mechanism is stretched, the corresponding seat is in the relaxing state; when both the footrest extension mechanism and the back mechanism are stretched to the limit position, the corresponding seat is in the lying state; and when both the footrest extension mechanism and the back mechanism are retracted to the limit position, the corresponding seat is in the sitting state.

The footrest extension mechanism and the seat stretching device are provided in the example. The footrest extension mechanism is stretched and retracted more flexibly and has a greater stretched length by adjusting the structure of the footrest extension mechanism, thereby better supporting legs and feet, improving the comfort of the seat, and meeting use requirements of users at different heights.

There are two mechanical stretching devices in the above examples of the present disclosure; and the two mechanical stretching devices are spaced apart and arranged symmetrically based on a central surface of the base. With a seat frame respectively provided on the mechanical stretching devices, the mechanical stretching devices are packaged into the finished sofa.

The present disclosure is to provide a seat unit with a simpler structure and a better ergonomic adaptation.

The present disclosure provides a mechanical stretching device for a movable seat unit. The mechanical stretching device includes left and right parts in a mirror symmetry; and hereinafter, descriptions are made to one part.

The mechanical stretching device according to the present disclosure includes:

- a linkage support, including a support structure for supporting a mechanical stretching device on ground and a linkage structure attachable to a seating portion of a seat unit;
- a back mechanism, the back mechanism being pivotally connected to the linkage support and being used for attaching to a backrest of the seat unit; and optionally, the back mechanism including a backrest connection element attached to the backrest and a back connecting rod pivotally connected to the backrest connection element; and
- a leg stretching structure provided with a footrest element, the leg stretching structure being pivotally connected to the linkage support and the footrest element being attached to a footrest of the seat unit.

According to the present disclosure, the mechanical stretching device can implement a sequential conversion or a reverse sequential conversion from a sitting state to a relaxing state and then to a lying state; in the sitting state, the footrest element may be folded below the seating portion; in the relaxing state, the footrest element may be stretched to be in front of the seating portion and inclined relative to a horizontal direction; and in the lying state, an angle between the backrest element and the seating portion may be increased relative to that in the relaxing state, and the footrest element may extend further forward and upward than in the relaxing state, such that a height of a highest point of the leg stretching structure relative to a horizontal plane is greater than that of a highest point of the back mechanism relative to the horizontal plane, thereby forming a so-called "zero gravity" position; and at the zero gravity position, a user of the seat unit may have a leg obviously higher than a head and at least higher than a chest.

According to the present disclosure, an angle formed between an extension direction of the footrest element in the lying state and the horizontal direction may be in a range between 9° and 23°, preferably between 14° and 21°, and more preferably between 18° and 19°; an included angle between the extension direction of the footrest element in the relaxing state and the horizontal direction may be less than the included angle between the extension direction of the footrest element in the lying state and the horizontal direction; and optionally, in the relaxing state, the angle formed between the extension direction of the footrest element and the horizontal direction may be in a range between 8° and 20°, preferably between 12° and 19°, and more preferably between 14° and 15°.

According to the present disclosure, in the lying state, an angle formed between the seating portion and the horizontal direction may be in a range between 8° and 17°, and preferably between 13° and 16°. In the technical solution, reducing the included angle between the seating portion in the lying state and the horizontal direction appropriately will make the user more comfortable in the lying state.

Optionally, in the lying state, a height difference between the highest point of the leg stretching structure and the highest point of the back mechanism may be in a range between 200 mm and 400 mm, and is preferably 265 mm.

According to the present disclosure, the support structure may include a base, a first support element, a second support element, and a base coupling component, where the first support element and the second support element are pivotally connected to the base respectively, and the base coupling component is provided between the first support element and the second support element.

According to the present disclosure, the linkage structure may include a lateral plate for attaching to the seating portion of the seat unit; the linkage structure may further include a first coupling element, a second coupling element and a third coupling element, a middle of the second coupling element may be rotatably connected to the lateral plate, one end of the second coupling element may be connected to one end of the first coupling element, the other end of the first coupling element may be connected to the first support element, the other end of the second coupling element may be connected to one end of the third coupling element, and the other end of the third coupling element may be connected to a footrest extension mechanism.

According to the present disclosure, the base coupling component may include a back coupling element and a seat coupling element; optionally, the back coupling element may be provided with multiple pivotal points; and the back coupling element may be respectively hinged to the back mechanism and optionally a back connecting rod of the back mechanism, the linkage structure and optionally the lateral plate of the linkage structure, the seat coupling element and the second support element by means of different pivotal points.

In the technical solution according to the present disclosure, a maximum allowable displacement moved forward by the linkage support is changed by adjusting a hinge point between the back connecting rod and the backrest connection element as well as a hinge point between the first support element and the base and the back coupling element, such that the degree at which the lateral plate is raised upward in the lying state is reduced, and the angle between the lateral plate and the horizontal direction is reduced, thereby improving the comfort of the user.

The mechanical stretching device according to the present disclosure may further include the leg stretching structure, and the leg stretching structure may include a first connecting rod, a second connecting rod, a third connecting rod, a fourth connecting rod and a first footrest element, where a rear end of the first connecting rod is hinged to the linkage structure, a front end of the first connecting rod is hinged to a rear end of the second connecting rod, a rear end of the third connecting rod is hinged to the linkage structure, a front end of the third connecting rod is hinged to a rear end of the fourth connecting rod, a front end of each of the second connecting rod and the fourth connecting rod is hinged to the first footrest element, a middle of the second connecting rod is further hinged to a middle of the third connecting rod, and optionally, an end of the second connecting rod close to the first connecting rod is provided with a first connecting point, and the second connecting rod is hinged to the middle of the third connecting rod at the first connecting point.

Some examples of the present disclosure provide a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism; and in the lying state, an angle between an extension direction of the footrest element and the horizontal direction is in a range between 9° and 23°.

In another example of the present disclosure, a movable seat unit is provided. The movable seat unit includes: a seating portion, a backrest, a footrest, a motor driving device, and a mechanical stretching device as described above.

Some other examples of the present disclosure provides a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism. In the lying state, a height difference between the highest point of the leg stretching structure and the highest point of the back mechanism is in a range between 200 mm and 400 mm; and in the lying state, an angle between an extension direction of the footrest element and the horizontal direction is in a range between 9° and 23°.

Some other examples of the present disclosure provide a mechanical stretching device for a movable seat unit, the mechanical stretching device includes: a linkage support that comprises a support structure configured to support the mechanical stretching device on ground and a linkage structure attachable to a seating portion of the seat unit; a back mechanism that is pivotally connected to the linkage support and is configured to attach to a backrest of the seat unit; and a leg stretching structure including a footrest element, and the leg stretching structure is pivotally connected to the linkage support, and the footrest element is attached to a footrest of the seat unit. The mechanical stretching device is configured to implement a sequential conversion or a reverse sequential conversion of the seat unit from a sitting state to a relaxing state and to a lying state. in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism. In the lying state, a height difference between the highest point of the leg stretching structure and the highest point of the back mechanism is in a range between 200 mm and 400 mm.

The seat device according to the prior art has the following defects: When the seat is stretched, the footrest mechanism easily rubs the ground to affect the use of the user; and the footrest mechanism of the seat only rotates simply and has a short stretched length overall, such that legs and feet cannot be completely supported in the relaxing state and the lying state to affect the comfort of the seat.

The existing mechanical stretching device provided with the extended footrest plate employs the conventional chute structure; the chute structure is prone to generate noise in use; and the chute structure has the poor structural stability because it is easily worn after repeated use to make the leg structure stretched or retracted unsuccessfully.

In view of the above technical problems, the present disclosure further provides an alternative solution for the leg stretching structure and the seat stretching device. In the alternative solution, the leg stretching structure is constructed as a footrest extension mechanism, including: a first connecting rod, a second connecting rod, a third connecting rod, a fourth connecting rod, a first footrest element, a coupling rod, a second footrest element, and a footrest connection element, where:

the second connecting rod includes one end hinged to the first footrest element, and the other end hinged to the first connecting rod, the first connecting rod is hinged to the linkage support of the seat unit, the fourth connecting rod includes one end hinged to the second footrest element, and the other end hinged to the third connecting rod, the first footrest element is hinged to one end of the coupling rod, and the other end of the coupling rod is hinged to a middle of the fourth connecting rod; and the footrest connection element includes a first connection element and a second connection element, the first connection element includes one end hinged to a middle of the second footrest element, and the other end hinged to one end of the second connection element, the other end of the second connection element is hinged to the middle of the second connecting rod, and a middle of the second connection element is hinged to the middle of the fourth connecting rod.

Further, the middle of the second footrest element may be provided with a first limit element, and when the first limit element abuts against the second connection element, the second footrest element may be retracted to a limit position to prevent the footrest element from being loose.

Further, an end of the second connecting rod close to the first connecting rod may be provided with a first connecting point, the second connecting rod may be hinged to a middle of the third connecting rod at the first connecting point, and the third connecting rod may be connected to the linkage support.

Further, an end of the second connecting rod close to the first footrest element may be provided with a second connecting point, and the second connecting rod may be connected to the second connection element at the second connecting point.

Further, an end of the fourth connecting rod close to the second footrest element may be sequentially provided with a footrest connecting point, a coupling rod connecting point and a connection element connecting point; and the fourth connecting rod may be connected to the second footrest element at the footrest connecting point, the fourth connecting rod may be connected to the coupling rod at the coupling rod connecting point, the fourth connecting rod may be connected to the second connection element at the connection element connecting point, and the coupling rod connecting point may be provided between the footrest connecting point and the connection element connecting point.

Further, a second connecting rod connecting point and a linkage point may be arranged on the first footrest element, and a distance from the linkage point to the coupling rod connecting point may be greater than that from the linkage point to the second connecting rod connecting point.

Further, when the footrest extension mechanism is retracted to the limit position, the first footrest element may be located above the second footrest element, and a footrest surface of the first footrest element and a footrest surface of the second footrest element may be in the same vertical plane.

Further, when the footrest extension mechanism is stretched to a limit position from a retracted position, the footrest surface of each of the first footrest element and the second footrest element may rotate upward, and the first footrest element and the second footrest element may be spaced apart from one another.

Further, the footrest extension mechanism may further include a footrest plate component, where the footrest plate component includes a first footrest plate and a second footrest plate, the first footrest plate is connected to the first footrest element, and the second footrest plate is connected to the second footrest element.

According to the alternative solution, the stretched length of the footrest plate of the seat can be increased by adjusting the structure of the footrest extension mechanism of the seat, thereby better supporting legs and feet of the user and improving the comfort of the seat.

According to the present disclosure, the linkage support may include a transmission structure for connecting a driving device to the leg stretching structure.

According to the alternative solution, the present disclosure further provides the corresponding seat stretching device, including the footrest extension mechanism, a linkage support, and a back mechanism, where:

one end of the linkage support is connected to the back mechanism, the other end of the linkage support is connected to the footrest extension mechanism, and the footrest extension mechanism is connected to the footrest plate component.

According to the present disclosure, the transmission structure may optionally include a first transmissive element and a second transmissive element that are connected to one another, the first transmissive element may be connected to the driving device, and the second transmissive element may be connected to the leg stretching structure.

The driving device may be optionally a manual driving device or a motor driving device, and may optionally include a linear motor.

With the foregoing technical solution, the present disclosure achieves the following beneficial effects.

In the footrest extension mechanism of the present disclosure, the first footrest element is hinged to the fourth connecting rod by means of the coupling rod, such that the first footrest element and the second footrest element can be drawn close and separated apart more flexibly; when the footrest extension mechanism is retracted, the two footrest elements are retracted and drawn close, with a small space occupation; and when the footrest extension mechanism is stretched, the stretched length of the footrest extension mechanism is increased to better support legs and feet, improve the comfort of the seat and meet use requirements of users at different heights.

Alternatively, the present disclosure further relates to a footrest extending structure and a stretching support, with corresponding technical solutions referring to the Chinese patent application CN 208625029 U; and contents disclosed in the patent literature should be completely included in the present disclosure.

On the other hand, the present disclosure further relates to a seat unit, including the mechanical stretching device, as well as a seating portion, a backrest, and a footrest attached to the mechanical stretching device, and optionally including a motor driving device.

The present disclosure may include dedicated hardware implementations such as application specific integrated circuits and other hardware devices. The hardware implementations can be constructed to implement one or more of the methods described herein. Examples that may include the apparatus and systems of various implementations can broadly include a variety of mechanical systems. One or more examples described herein may implement functions using two or more specific interconnected hardware devices or units with related control and data signals that can be communicated between and through the units, or as portions of the device. Accordingly, the apparatus or system disclosed may encompass software and hardware implementations. The terms "circuit," "sub-circuit," "unit," or "sub-unit" may include memory (shared, dedicated, or group) that stores code or instructions that can be executed. The unit or circuit may include one or more components that are connected.

The above examples of the present disclosure focus on the differences among various examples, and the different optimization features among the various examples can be combined to form a better example as long as they are not contradictory, which will not be detailed here for brevity concern.

The above-described are only examples of the present disclosure, and are not used to limit the present disclosure. For those skilled in the art, various modifications and variations are possible. Any modification, equivalent substitution, improvement, and others made within the spirit and principle of the present disclosure shall be included within the scope the present disclosure.

The invention claimed is:

1. A mechanical stretching device for a movable seat unit, comprising:

a linkage support, wherein the linkage support comprises a support structure configured to support the mechanical stretching device on ground and a linkage structure attachable to a seating portion of the seat unit;

a back mechanism, wherein the back mechanism is pivotally connected to the linkage support and is configured to attach to a backrest of the seat unit; and a leg stretching structure comprising a footrest element, wherein the leg stretching structure is pivotally connected to the linkage support, and the footrest element is attached to a footrest of the seat unit, wherein:

the mechanical stretching device is configured to implement a sequential conversion or a reverse sequential conversion of the seat unit from a sitting state to a relaxing state and to a lying state;

in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism; and in the lying state, an angle between an extension direction of the footrest element and the horizontal direction is in a range between 9° and 23°, and in the lying state, a height difference between the highest point of the leg stretching structure and the highest point of the back mechanism is in a range between 200 mm and 400 mm, such that a user of the seat unit has a leg at least higher than their chest to form a zero gravity position.

2. The mechanical stretching device according to claim 1, wherein in the lying state, the height difference between the highest point of the leg stretching structure and the highest point of the back mechanism is 265 mm; or in the lying state, the angle between the extension direction of the footrest element and the horizontal direction is in a range between 14° and 21°; or the angle between the extension direction of the footrest element and the horizontal direction is in a range between 18° and 19°.

3. The mechanical stretching device according to claim 1, wherein an angle between the extension direction of the footrest element in the relaxing state and the horizontal direction is less than the angle between the extension direction of the footrest element in the lying state and the horizontal direction; and the angle formed between the extension direction of the footrest element in the relaxing state and the horizontal direction is in a range between 8° and 20°, or in a range between 12° and 19°, or in a range between 14° and 15°.

4. The mechanical stretching device according to claim 1, wherein in the lying state, an angle between the seating portion and the horizontal direction is in a range between 8° and 17°, or in a range between 13° and 16°.

5. The mechanical stretching device according to claim 1, wherein the support structure comprises a base, a first support element, a second support element, and a base coupling component, wherein:

the first support element and the second support element are pivotally connected to the base, and the base coupling component is disposed between the first support element and the second support element.

6. The mechanical stretching device according to claim 1, wherein the linkage structure comprises a lateral plate configured to attach to the seating portion of the seat unit.

7. The mechanical stretching device according to claim 5, wherein the base coupling component comprises: a back coupling element, a seat coupling element, and a lateral plate coupling element, wherein the back coupling element is pivotally coupled to the back mechanism, the linkage structure, the seat coupling element, and the second support element.

8. The mechanical stretching device according to claim 1, wherein the leg stretching structure comprises a first connecting rod, a second connecting rod, a third connecting rod, a fourth connecting rod, and a first footrest element, wherein:

a rear end of the first connecting rod is hinged to the linkage structure, a front end of the first connecting rod is hinged to a rear end of the second connecting rod, a rear end of the third connecting rod is hinged to the linkage structure, a front end of the third connecting rod is hinged to a rear end of the fourth connecting rod, a front end of each of the second connecting rod and the fourth connecting rod is hinged to the first footrest element, a middle of the second connecting rod is hinged to a middle of the third connecting rod; and an end of the second connecting rod close to the first connecting rod is provided with a first connecting point, and the second connecting rod is hinged to the middle of the third connecting rod at the first connecting point.

9. The mechanical stretching device according to claim 8, wherein the leg stretching structure comprises a footrest extension mechanism, and the footrest extension mechanism further comprises a coupling rod, a second footrest element, and a footrest connection element;

the second connecting rod comprises a first end hinged to the first footrest element, and a second end hinged to the first connecting rod, the first connecting rod is hinged to the linkage support of the seat unit, the fourth connecting rod comprises a first end hinged to the second footrest element, and a second end hinged to the third connecting rod, the first footrest element is hinged to a first end of the coupling rod, and a second end of the coupling rod is hinged to a middle of the fourth connecting rod;

the footrest connection element comprises a first connection element and a second connection element, the first connection element comprises a first end hinged to a middle of the second footrest element, and a second end hinged to a first end of the second connection element, a second end of the second connection element is hinged to the middle of the second connecting rod, and a middle of the second connection element is hinged to the middle of the fourth connecting rod;

the middle of the second footrest element is provided with a first limit element, and when the first limit element abuts against the second connection element, the second footrest element is retracted to a limit position to prevent the footrest element from being loose;

an end of the second connecting rod close to the first footrest element is provided with a second connecting point, and the second connecting rod is connected to the second connection element at the second connecting point;

an end of the fourth connecting rod close to the second footrest element is sequentially provided with a footrest connecting point, a coupling rod connecting point, and a connection element connecting point; and the fourth connecting rod is connected to the second footrest element at the footrest connecting point, the fourth connecting rod is connected to the coupling rod at the coupling rod connecting point, the fourth connecting rod is connected to the second connection element at the connection element connecting point, and the coupling rod connecting point is provided between the footrest connecting point and the connection element connecting point.

10. The mechanical stretching device according to claim 9, wherein a second connecting rod connecting point and a linkage point are arranged on the first footrest element, and a distance from the linkage point to the coupling rod connecting point is greater than that from the linkage point to the second connecting rod connecting point;

when the footrest extension mechanism is retracted to the limit position, the first footrest element is located above the second footrest element, and a footrest surface of the first footrest element and a footrest surface of the second footrest element are in the same vertical plane; and when the footrest extension mechanism is stretched to a limit position from a retracted position, the footrest surface of each of the first footrest element and the second footrest element rotates upward, and the first footrest element and the second footrest element are spaced apart from one another; and the footrest extension mechanism further comprises a footrest plate component, wherein the footrest plate component comprises a first footrest plate and a second footrest plate, the first footrest plate is connected to the first footrest element, and the second footrest plate is connected to the second footrest element.

11. The mechanical stretching device according to claim 1, wherein the linkage support comprises a transmission structure for connecting a driving device to the leg stretching structure, wherein:

the transmission structure comprises a first transmissive element and a second transmissive element that are connected to one another, the first transmissive element is connected to the driving device, and the second transmissive element is connected to the leg stretching structure; and the driving device comprises a manual driving device, a motor driving device, or a linear motor.

12. A movable seat unit, comprising:

a seating portion, a backrest, a footrest, and a mechanical stretching device attached to the foot rest, wherein the mechanical stretching device further comprises:

a linkage support, wherein the linkage support comprises a support structure configured to support the mechanical stretching device on ground and a linkage structure attachable to the seating portion of the seat unit;

a back mechanism, wherein the back mechanism is pivotally connected to the linkage support and is configured to attach to the backrest of the seat unit; and a leg stretching structure comprising a footrest element, wherein the leg stretching structure is pivotally connected to the linkage support, and the footrest element is attached to the footrest of the seat unit, wherein:

the mechanical stretching device is configured to implement a sequential conversion or a reverse sequential conversion of the seat unit from a sitting state to a relaxing state and to a lying state;

in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism; and in the lying state, an angle between an extension direction of the footrest element and the horizontal direction is in a range between 9° and 23°, and in the lying state, a height difference between the highest point of the leg stretching structure and the highest point of the back mechanism is in a range between 200 mm and 400 mm, such that a user of the seat unit has a leg at least higher than their chest to form a zero gravity position.

13. The movable seat unit according to claim 12, wherein in the lying state, the height difference between the highest point of the leg stretching structure and the highest point of the back mechanism is 265 mm; or in the lying state, the angle between the extension direction of the footrest element and the horizontal direction is in a range between 14° and 21°; or the angle between the extension direction of the footrest element and the horizontal direction is in a range between 18° and 19°.

14. The movable seat unit according to claim 12, wherein an angle between the extension direction of the footrest element in the relaxing state and the horizontal direction is less than the angle between the extension direction of the footrest element in the lying state and the horizontal direction; and the angle formed between the extension direction of the footrest element in the relaxing state and the horizontal direction is in a range between 8° and 20°, or in a range between 12° and 19°, or in a range between 14° and 15°.

15. The movable seat unit according to claim 12, wherein in the lying state, an angle between the seating portion and the horizontal direction is in a range between 8° and 17°, or in a range between 13° and 16°.

16. The movable seat unit according to claim 12, wherein the support structure comprises a base, a first support element, a second support element, and a base coupling component, wherein:

the first support element and the second support element are pivotally connected to the base, and the base coupling component is disposed between the first support element and the second support element.

17. The movable seat unit according to claim 12, wherein the linkage structure comprises a lateral plate configured to attach to the seating portion of the seat unit.

18. The movable seat unit according to claim 12, wherein the linkage support comprises a transmission structure for connecting a driving device to the leg stretching structure, wherein:

the transmission structure comprises a first transmissive element and a second transmissive element that are connected to one another, the first transmissive element is connected to the driving device, and the second transmissive element is connected to the leg stretching structure; and the driving device comprises a manual driving device, a motor driving device, or a linear motor.

19. A mechanical stretching device for a movable seat unit, comprising:

a linkage support, wherein the linkage support comprises a support structure configured to support the mechanical stretching device on ground and a linkage structure attachable to a seating portion of the seat unit;

a back mechanism, wherein the back mechanism is pivotally connected to the linkage support and is configured to attach to a backrest of the seat unit; and a leg stretching structure comprising a footrest element, wherein the leg stretching structure is pivotally connected to the linkage support, and the footrest element is attached to a footrest of the seat unit, wherein:

the mechanical stretching device is configured to implement a sequential conversion or a reverse sequential conversion of the seat unit from a sitting state to a relaxing state and to a lying state;

in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism, wherein in the lying state, a height difference between the highest point of the leg stretching structure and the highest point of the back mechanism is in a range between 200 mm and 400 mm, such that a user of the seat unit has a leg at least higher than their chest to form a zero gravity position.

20. A mechanical stretching device for a movable seat unit, comprising:

a linkage support, wherein the linkage support comprises a support structure configured to support the mechanical stretching device on ground and a linkage structure attachable to a seating portion of the seat unit;

a back mechanism, wherein the back mechanism is pivotally connected to the linkage support and is configured to attach to a backrest of the seat unit; and a leg stretching structure comprising a footrest element, wherein the leg stretching structure is pivotally connected to the linkage support, and the footrest element is attached to a footrest of the seat unit, wherein:

the mechanical stretching device is configured to implement a sequential conversion or a reverse sequential conversion of the seat unit from a sitting state to a relaxing state and to a lying state;

in the sitting state, the footrest element is folded below the seating portion; in the relaxing state, the footrest element is stretched to be in front of the seating portion and inclined relatively to a horizontal direction; and in the lying state, an angle between the backrest and the seating portion is increased compared to the angle between the backrest and the seating portion in the relaxing state, and the footrest element extends forward and upward from a position of the footrest element in the relaxing state, such that a height of a highest point of the leg stretching structure is greater than a height of a highest point of the back mechanism, wherein in the lying state, a height difference between the highest point of the leg stretching structure and the highest point of the back mechanism is in a range between 200 mm and 400 mm, such that a user of the seat unit has a leg at least higher than their chest to form a zero gravity position; and in the lying state, an angle between an extension direction of the footrest element and the horizontal direction is in a range between 9° and 23°.

* * * * *